US009731515B2

(12) United States Patent
Anderson

(10) Patent No.: US 9,731,515 B2
(45) Date of Patent: Aug. 15, 2017

(54) VARIABLE HUMIDITY DRYING

(71) Applicant: HEWLETT-PACKARD DEVELOPMENT COMPANY, L.P., Houston, TX (US)

(72) Inventor: Ronald R. Anderson, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/912,494

(22) PCT Filed: Aug. 29, 2013

(86) PCT No.: PCT/US2013/057240

§ 371 (c)(1),
(2) Date: Feb. 17, 2016

(87) PCT Pub. No.: WO2015/030766

PCT Pub. Date: Mar. 5, 2015

(65) Prior Publication Data

US 2016/0214405 A1 Jul. 28, 2016

(51) Int. Cl.
*B41J 11/00* (2006.01)
*B41F 23/04* (2006.01)
(Continued)

(52) U.S. Cl.
CPC ..... *B41J 11/0015* (2013.01); *B41F 23/04* (2013.01); *B41J 3/60* (2013.01); *B41J 11/002* (2013.01);
(Continued)

(58) Field of Classification Search
CPC ..... B41J 11/0015; B41J 11/002; B41J 3/60; F26B 3/04; F26B 15/02; F26B 23/04; B41F 23/04
See application file for complete search history.

(56) References Cited

U.S. PATENT DOCUMENTS 3,377,056 A * 4/1968 Boye ..... D21F 5/00 34/122
5,383,288 A * 1/1995 Ilmarinen ..... D21F 5/00 34/119
(Continued)

FOREIGN PATENT DOCUMENTS

EP 0704043 6/1998
FR 2553085 4/1985
(Continued)

OTHER PUBLICATIONS

Deventer, H.C.V.; Feasibility of Energy Efficient Steam Drying of Paper and Textile Including Process Integration.
(Continued)

*Primary Examiner* — Bradley Thies
(74) *Attorney, Agent, or Firm* — HP Inc. Patent Department

(57) ABSTRACT

In one example, a multi-stage hot air dryer in which each successive stage is configured to take in air discharged from a prior stage and discharge it on to an article moving through the dryer from the last stage to the first stage such that the article is exposed to higher humidity air first in the dryer and to lower humidity air last in the dryer.

15 Claims, 8 Drawing Sheets

(51) Int. Cl.

| | |
|---|---|
| ***B41J 3/60*** | (2006.01) |
| ***F26B 3/04*** | (2006.01) |
| ***F26B 15/02*** | (2006.01) |
| ***F26B 23/04*** | (2006.01) |
| ***F26B 13/14*** | (2006.01) |

(52) U.S. Cl.
CPC ..... *F26B 3/04* (2013.01); *F26B 13/145* (2013.01); *F26B 15/02* (2013.01); *F26B 23/04* (2013.01)

(56) References Cited

U.S. PATENT DOCUMENTS

| | | | | |
|---|---|---|---|---|
| 5,657,555 | A | 8/1997 | Milojevic et al. | |
| 5,713,138 | A | 2/1998 | Rudd | |
| 6,311,410 | B1 | 11/2001 | Heikkila et al. | |
| 6,473,997 | B1 * | 11/2002 | Berg | D21F 5/002 34/115 |
| 6,877,247 | B1 | 4/2005 | DeMoore | |
| 8,046,934 | B2 | 11/2011 | Lenoir | |
| 2012/0260518 | A1 | 10/2012 | Melgaard et al. | |
| 2013/0215202 | A1 | 8/2013 | Koller et al. | |
| 2015/0174924 | A1 | 6/2015 | Fuchioka et al. | |

FOREIGN PATENT DOCUMENTS

| | | |
|---|---|---|
| JP | 2007192528 | 8/2007 |
| JP | 2011121193 | 6/2011 |
| JP | 2012051156 | 3/2012 |
| JP | 2013107211 | 6/2013 |
| WO | WO-8908809 | 9/1989 |
| WO | WO-2012175810 | 12/2012 |

OTHER PUBLICATIONS

International Searching Authorty. International Search Report. Date of mailing May 19, 2014. Application No. PCT/US2013/057240. Mail date Aug. 29, 2013.

* cited by examiner

VARIABLE HUMIDITY DRYING

BACKGROUND

In some high speed inkjet web printers, often called web presses, the first side of the web is printed at a first printing unit, the web is inverted, and then the second side of the web is printed at a second printing unit. The web is guided through a dryer after each side is printed to dry the ink.

DRAWINGS

The same part numbers designate the same or similar parts throughout the figures.

DESCRIPTION

Inkjet web presses can benefit from the use of higher water content inks. Higher water content inks, however, increase the need for higher capacity dryers, particular to support fast printing speeds. Of course, it is desirable to minimize the size and cost of the press and the cost of operating the press. A new dryer has been developed to help increase drying capacity in high speed inkjet web presses while minimizing any increase in size and cost associated with the added drying capacity. In one example, each successive stage of a multi-stage dryer is configured to take in air discharged from a prior stage, reheat the air and discharge it on to the web moving through the dryer from the last dryer stage to the first dryer stage, such that the web is exposed to the highest humidity air first in the dryer and to the lowest humidity air last in the dryer. As described in detail below, humidity generated in the drying process is used beneficially to promote dryer efficiency. Also, unlike conventional hot air dryers that use one blower to handle air flow, multiple smaller blowers may be used for better flow control to further improve drying efficiency.

Examples of the new dryer and drying process are not limited to inkjet web presses or to printing in general, but may be implemented in other devices and for other applications. Accordingly, the examples described herein and shown in the Figures illustrate but do not limit the invention.

Figure 1:
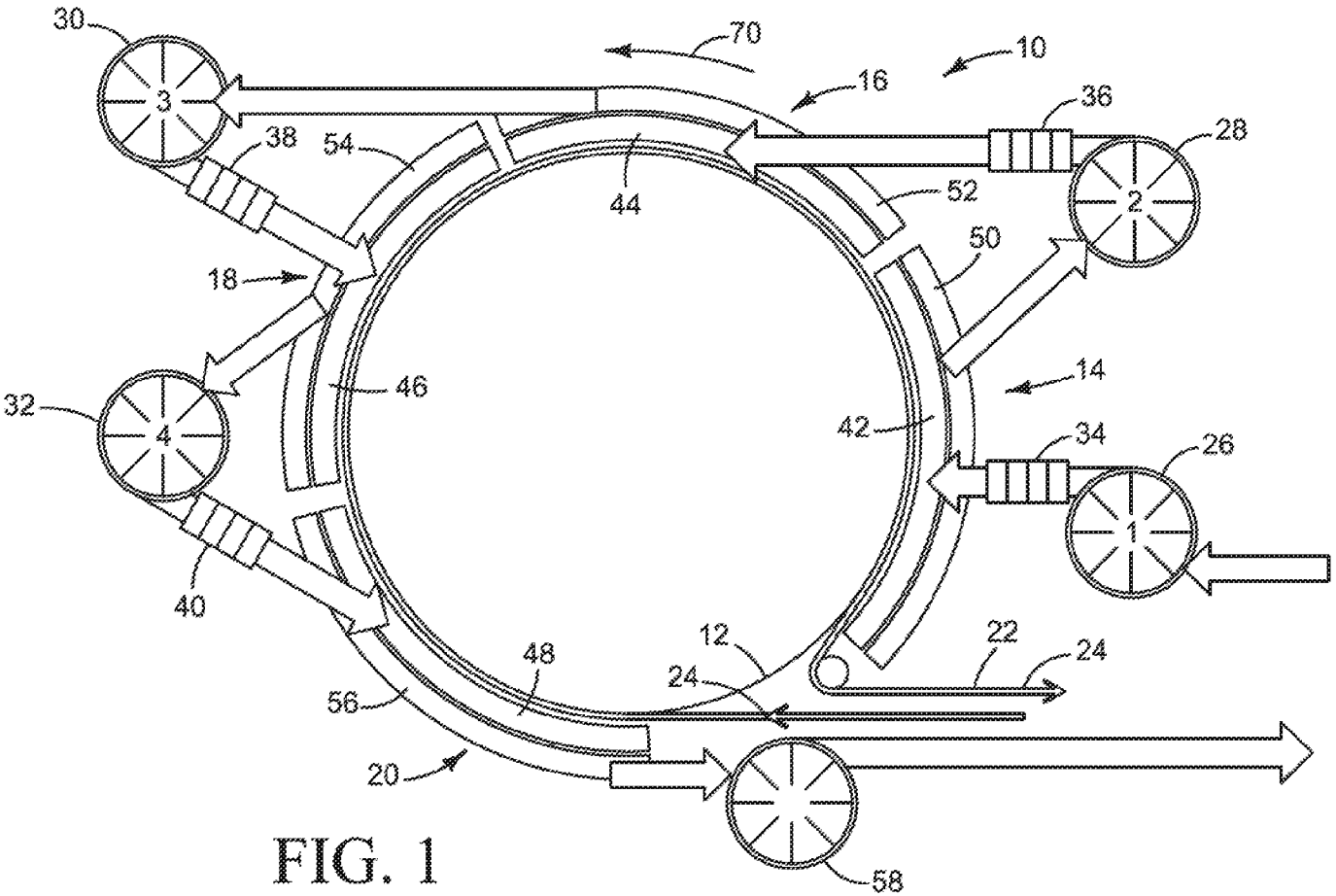
FIG. 1 is a diagram illustrating one example of a multiple stage counterflow dryer.
Figure 2:
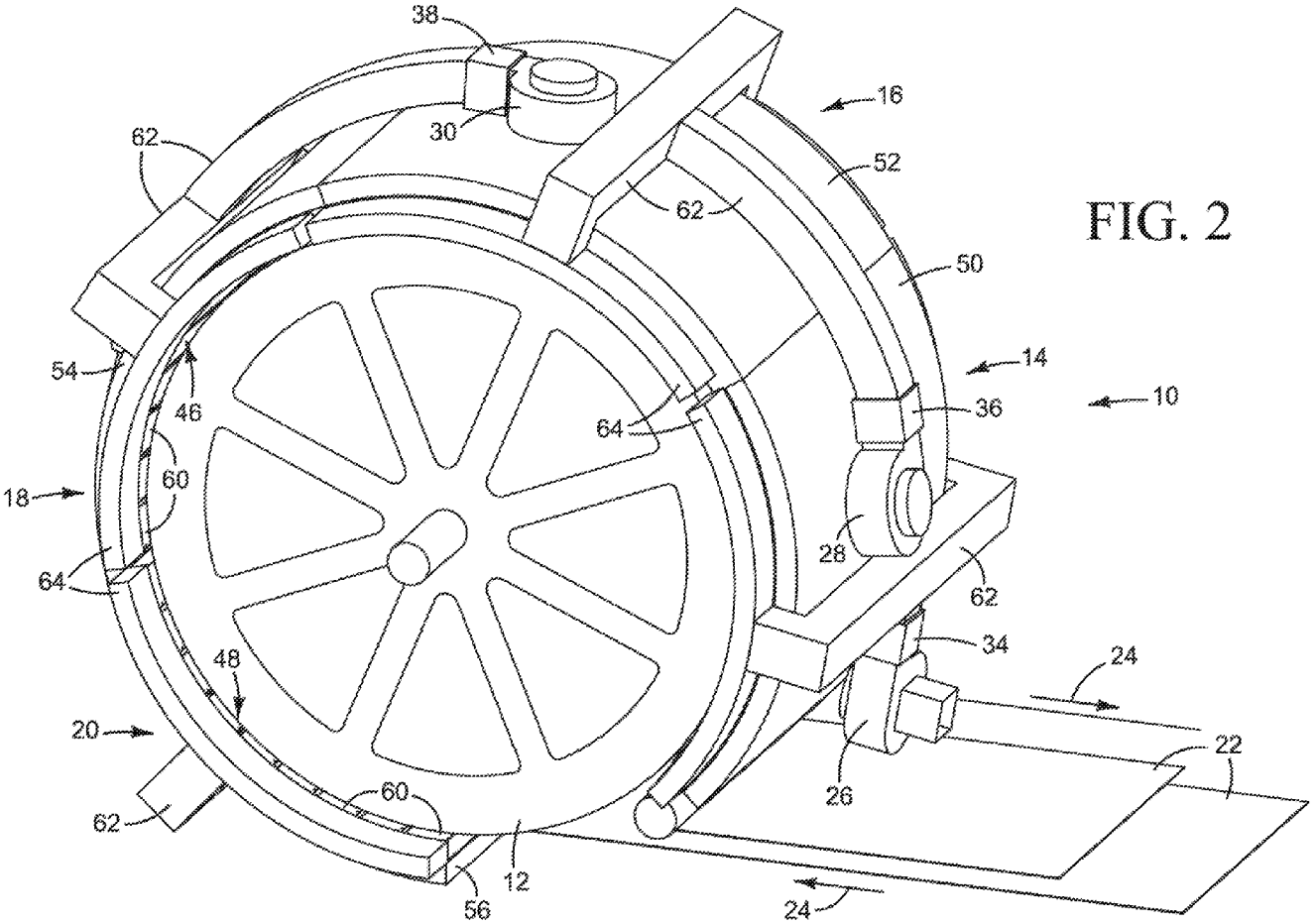
FIGS. 2 and 3 are perspective and side elevation views, respectively, illustrating one example implementation of a counterflow dryer such as the one shown in the diagram of FIG. 1.
Figure 3:
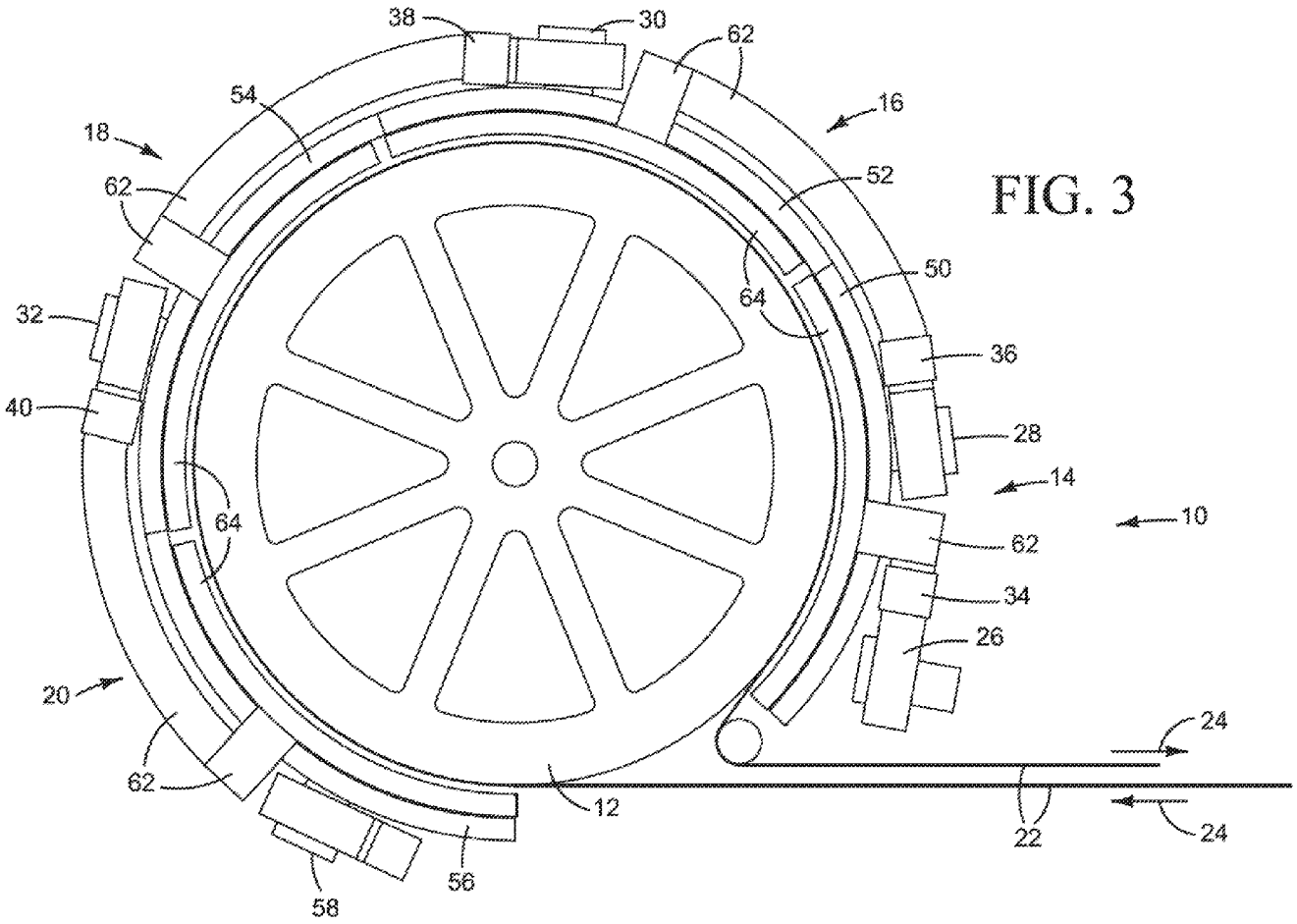
Figure 4:
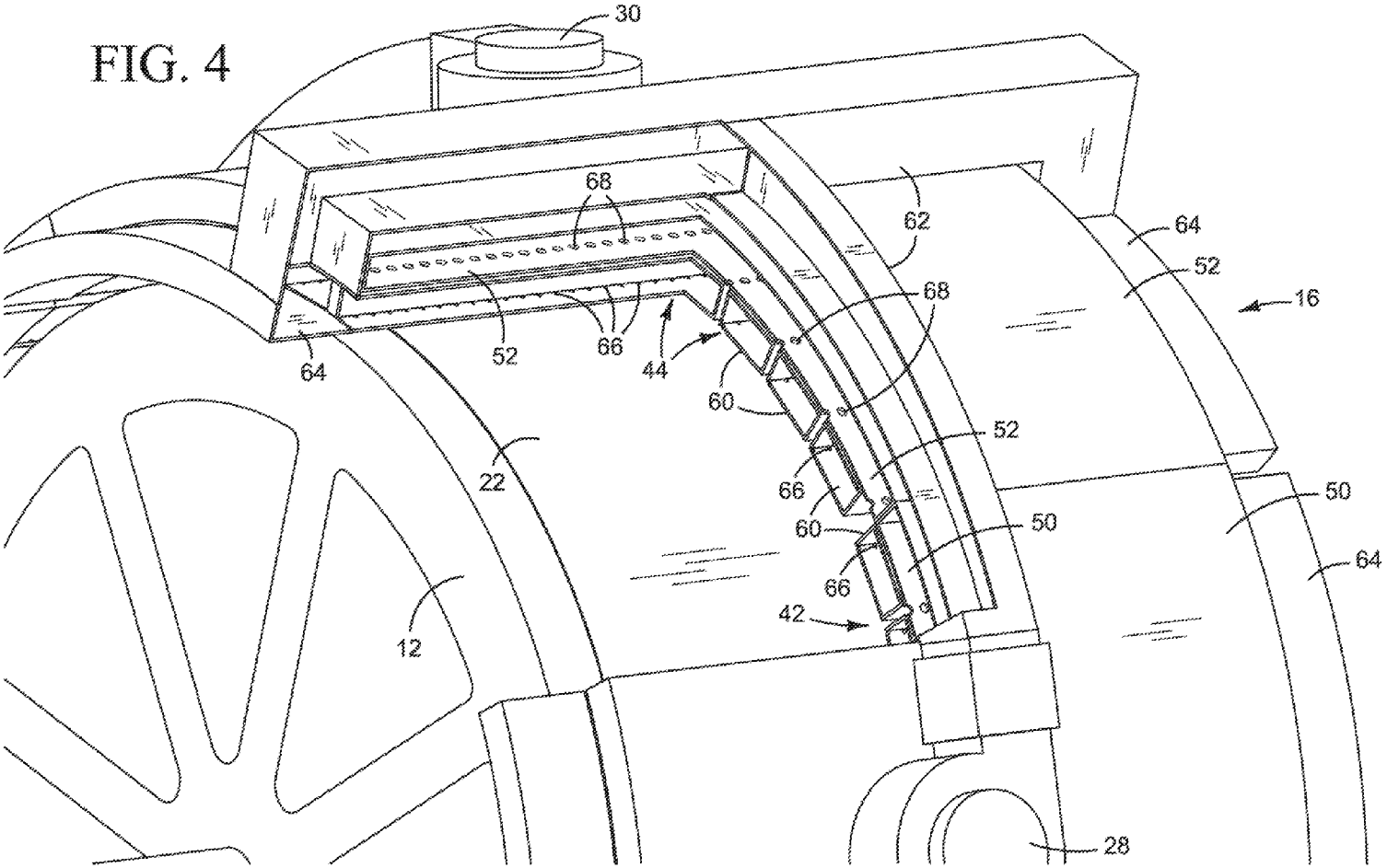
FIG. 4 is a detail and partial cut-away view of the dryer from FIG. 2.

FIG. 1 is a diagram illustrating one example of a multi-stage counterflow dryer 10. FIGS. 2-4 illustrate one example implementation of a dryer 10 shown in the diagram of FIG. 1. Referring to FIGS. 1-4, dryer 10 includes a drum 12 and stages 14, 16, 18 and 20 arranged next to one another around the circumference of drum 12. A web or other article 22 to be dried is moved over or along drum 12 in a first direction, clockwise in this example, as indicated by arrows 24. A driven drum 12 may be used to move article 22 past dryer stages 14-20, or a stationary or idler drum 12 may be used to guide article 22 past dryer stages 14-20. Each dryer stage 14-20 includes an air pump 26, 28, 30, 32, a heater 34, 36, 38, 40 and a discharge air chamber 42, 44, 46, 48. An air pump used in a hot air dryer is commonly referred to as a "blower." Each prior stage 14, 16 and 18 also includes a return air chamber 50, 52, 54.

Each successive dryer stage 16, 18 and 20 is configured to take in air discharged from a prior stage 14, 16 and 18, respectively, reheat the air and discharge it on to article 22 moving through dryer 10 from the last stage 20 to the first stage 14 such that article 22 is exposed to the highest humidity air first in dryer 10 and to the lowest humidity air last in dryer 10. In operation, at first dryer stage 14, ambient air is heated and pumped into discharge chamber 42 and on to article 22 where it picks up moisture from article 22, which is at the last part of its passage through dryer 10. The now more humid air discharged on to article 22 at first dryer stage 14 is collected in return chamber 50. At second dryer stage 16, air from return chamber 50 is heated and pumped into discharge chamber 44 and on to article 22 where it picks up more moisture from article 22, which is at a middle part of its passage through dryer 10.

The now more humid air discharged on to article 22 at second dryer stage 16 is collected in return chamber 52. At third dryer stage 18, air from return chamber 52 is heated and pumped into discharge chamber 46 and on to article 22 where it picks up more moisture from article 22, which is at a middle part of its passage through dryer 10. The now more humid air discharged on to article 22 at third dryer stage 18 is collected in return chamber 54. At the fourth and last dryer stage 20, air from return chamber 54 is heated and pumped into discharge chamber 48 and on to article 22, which is at the first part of its passage through dryer 10. If desired, the air discharged on to article 22 at fourth dryer stage 20 may be collected in a chamber 56 and actively exhausted through a blower 58.

While each return chamber 50, 52, 54 is associated with a prior dryer stage 14, 16, 18, respectively, in the above description, each such return chamber 50, 52, 54 could be associated with the corresponding successive dryer stage 16, 18, 20. Whichever association is used, each return chamber is used to supply air from a prior dryer stage to a successive dryer stage.

Referring now specifically to FIGS. 2-4, in the example shown, each discharge chamber 42-48 is configured as a group of discrete plenums 60 arranged along the circumference of drum 12 at each dryer stage 14-20. Dryer plenums 60 are commonly referred to as "air bars." Each return chamber 50-56 is configured as a single chamber overlapping the corresponding air bars 60 at each dryer stage 14-20. Air is pumped into each air bar 60 through supply ducts 62 and headers 64. For example, ducts 62 positioned circumferentially around drum 12 over return chambers 50-56 carry air from blowers 26-32 to headers 64 at each end of air bars 60. Air is discharged on to article 22 through nozzles 66 (FIG. 4) in each air bar 60. Air is collected in return chambers 50-56 through openings 68 (FIG. 4) positioned along the gaps between air bars 60.

Figure 5:
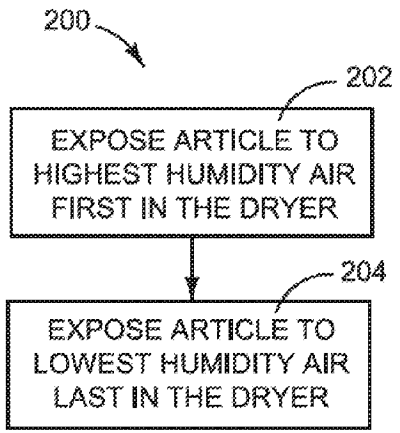
FIG. 5 is a flow chart illustrating one example of a drying process such as might be implemented in the dryer shown in FIG. 1.

FIG. 5 is a flow chart illustrating one example of a new drying process 200 such as might be implemented in dryer 10 shown in FIG. 1. As described above, the drying air moves through dryer 10 in a direction 70 (FIG. 1) counter to the direction 24 (FIG. 1) article 22 moves through dryer 10, collecting moisture from the increasingly damp (or wet) article 22 as the air cascades from one stage to the next around drum 12. Accordingly, and referring to FIG. 5, article 22 is exposed to the highest humidity air first in dryer 10 (step 202) and to the lowest humidity air last in the dryer 10 (step 204).

Figure 6:
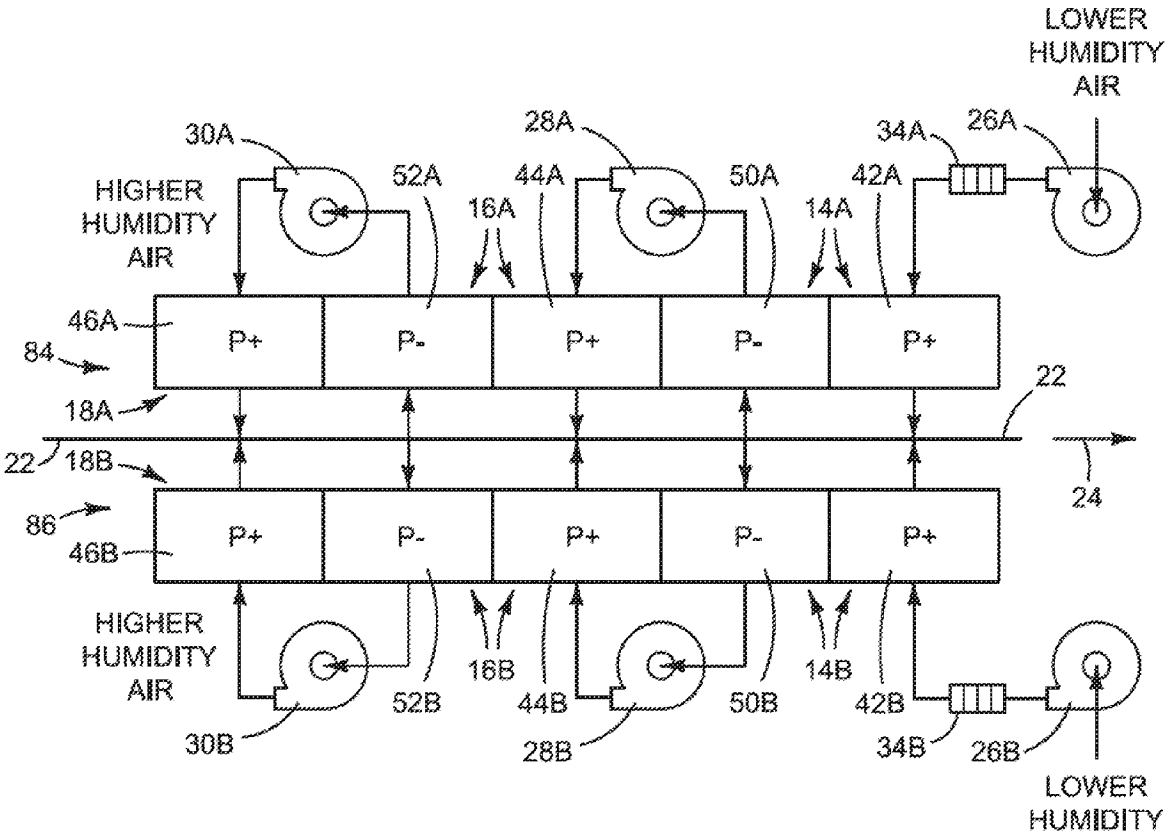
FIG. 6 is a diagram illustrating another example of a multi-stage counterflow dryer.

FIG. 6 is a diagram illustrating another example of a multiple stage counterflow dryer 10. Referring to FIG. 6, in this example dryer 10 includes a first set 84 of three dryer stages 14A, 16A and 18A arranged in line next to one another to dry one side of an article 22 moving straight through dryer 10, and a second set 86 of three dryer stages 14B, 16B and 18B to dry the other side of article 22. In this example, each lower pressure (P−) return chamber 50A, 52A, 50B, 52B is positioned next to the corresponding higher pressure (P+) discharge chamber 42A, 44A, 42B, 44B along article 22. Also, in this example, the air for each stage set 84, 86 is heated only once, at the first stage 14A, 14B, and successive, last dryer stage 18A, 18B does not include a return air chamber.

Airflow is managed in dryer 10 by breaking up the convective air zone into multiple stages in which each successive stage utilizes moisture removed from article 22 in the prior stage. Hot humid air is efficient at heat transfer—getting heat energy to the article to be dried. Hot dry air is efficient at mass transfer—evaporating moisture from the article. The higher humidity of the hot air applied to article 22 first in dryer 10 at the later dryer stage(s) promotes heat transfer, heating article 22 to the desired temperature faster than if drier air were applied. The progressively dryer hot air applied to article 22 at the earlier dryer stages promotes mass transfer, accelerating evaporation to the desired dryness. This type of multi-stage dryer can also realize energy efficiency by reusing heat still in the air discharged from each prior stage. Configurations for a dryer 10 other than the examples shown in the figures are possible. For example, it may be desirable in some implementations to use more or fewer dryer stages, other paths for the article to be dried, and/or with other arrangements for the discharge and return chambers.

Figure 7:
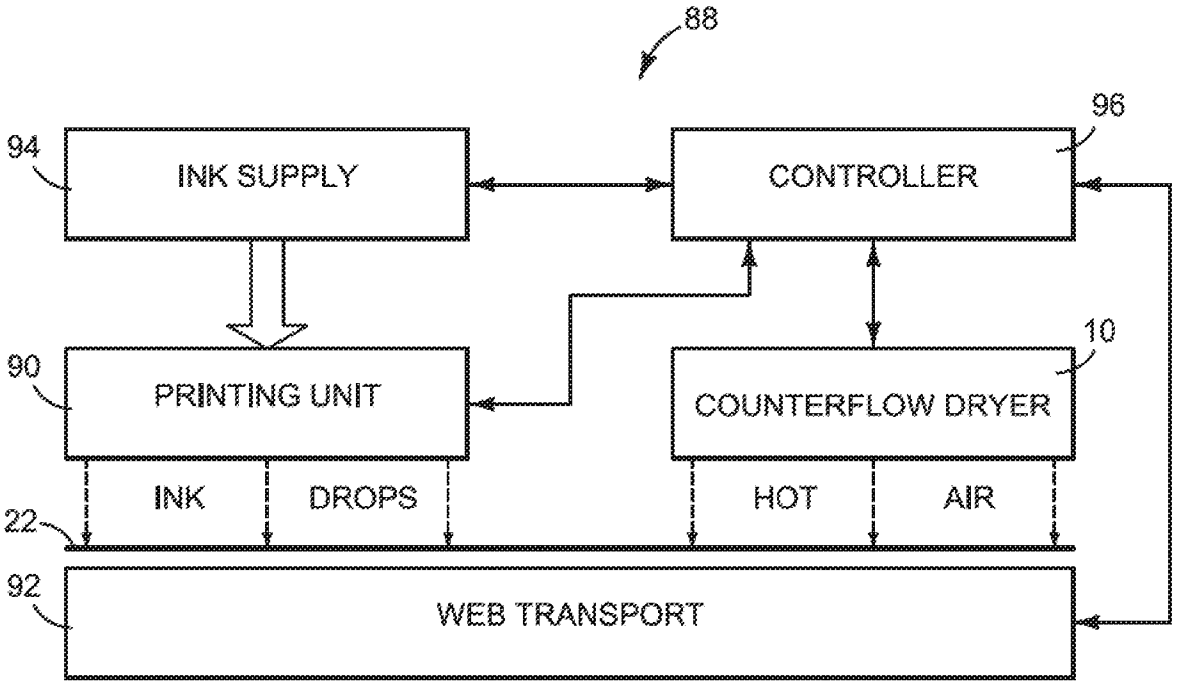
FIG. 7 is a block diagram illustrating one example of an inkjet printer implementing a multi-stage counterflow dryer.
Figure 8:
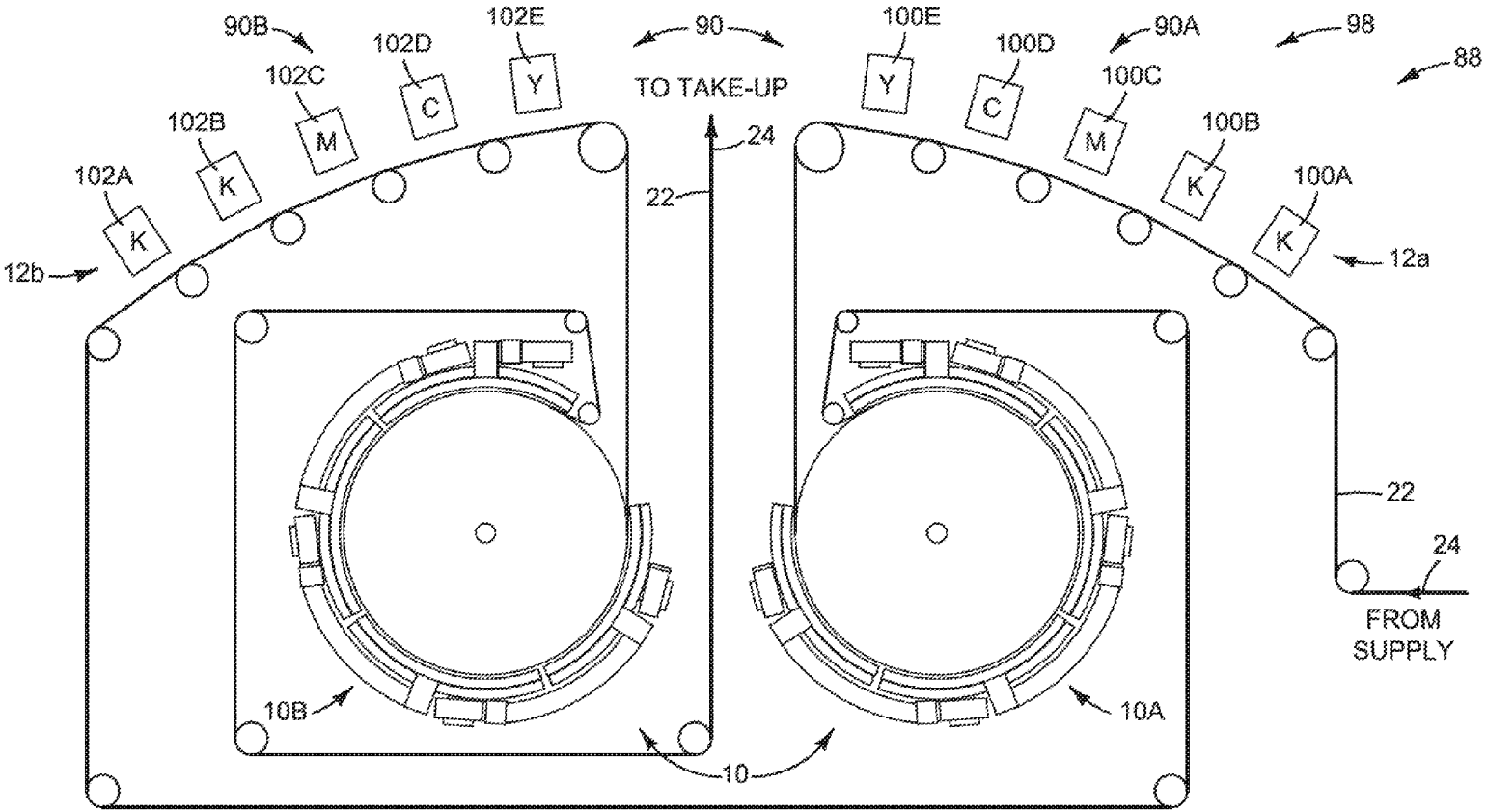
FIG. 8 is a side view illustrating a counterflow dryer such as the one shown in FIGS. 2-4 implemented in a single station inkjet web printer.
Figure 9:
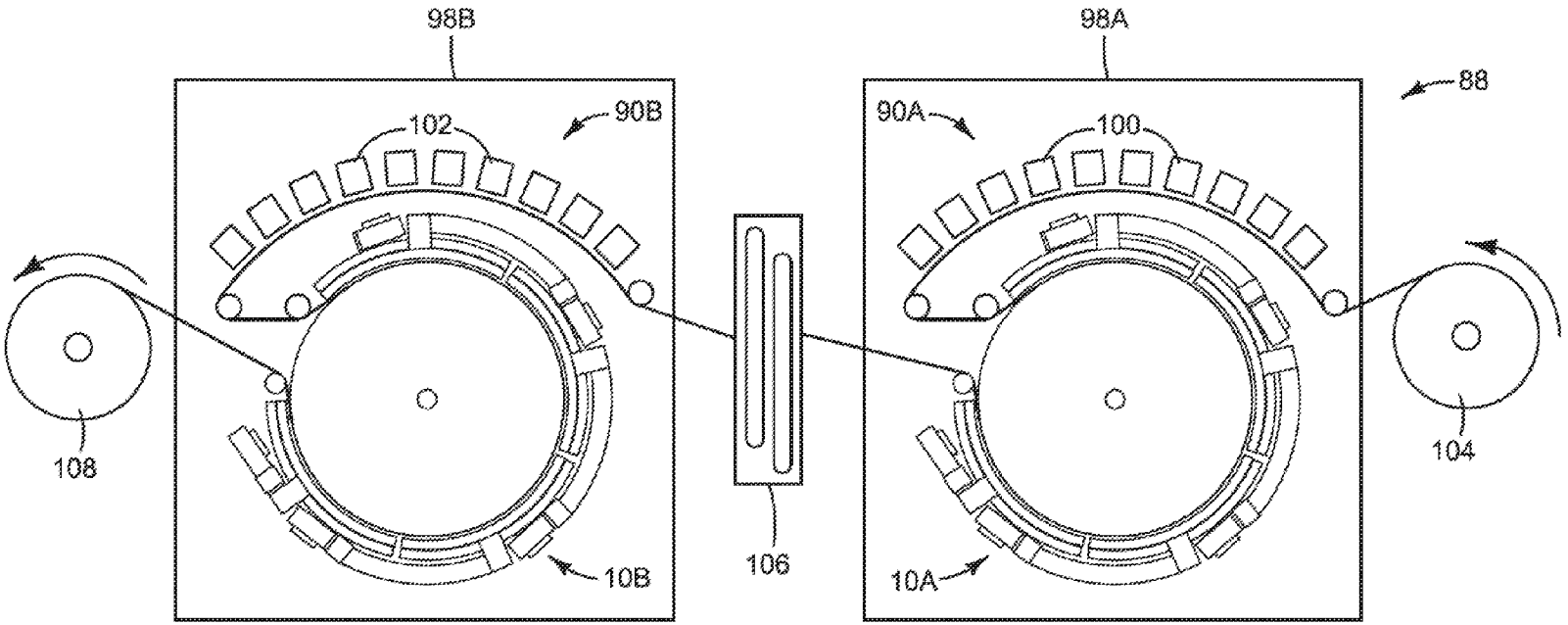
FIG. 9 is a side view illustrating a counterflow dryer such as the one shown in FIGS. 2-4 implemented in a two station inkjet web printer.

FIG. 7 is a block diagram illustrating an inkjet printer 88 implementing a multi-stage counterflow dryer 10. FIGS. 8 and 9 are side elevation views illustrating two examples of an inkjet web printer 88 implementing a dryer 10 such as that shown in FIGS. 2-4. Although a web printer is shown in FIGS. 7-9, examples of the new dryer could also be implemented in a sheet printer, for example using a vacuum drum or belt type substrate transport. Referring first to the block diagram of FIG. 7, printer 88 includes a printing unit 90, a print substrate web 22, a web transport 92, a multi-stage counterflow dryer 10, an ink supply 94, and a controller 96. Printing unit 90 represents generally an inkjet printing device for applying ink to print substrate 22 as it moves through a print zone near unit 90 at the urging of transport 92. Controller 96 represents generally the programming, processors and associated memories, and the electronic circuitry and components needed to control the operative elements of printer 88. For a large, high speed inkjet web printer 88, controller 22 may include servers and computer work stations as well as central processing units and associated memories (RAM and hard drives for example), and application specific integrated circuits.

FIG. 8 is a side view illustrating a counterflow dryer 10 such as the one shown in FIGS. 2-4 implemented in a single station inkjet web printer 88. Referring to FIG. 8, printer 88 includes a web supply (not shown) from which web 22 is fed to a printing station 98 and a web take-up (not shown) to which web 14 is taken after passing through printing station 98. Printing station 98 includes an arched printing unit 90 and a dryer 18 positioned under and contained within the footprint of arched printing unit 90. Arched printing unit 90 includes a first printing unit 90A for printing on one side of web 22 and a second printing unit 90B for printing on the other side of web 14. First printing unit 90A includes a first series of print bars 100A-100E arranged along an are on one side of arched printing unit 90. Second printing unit 90B includes a second series of print bars 102A-102E arranged along an arc on the other side of arched printing unit 90. In one example arrangement, print bars 100A, 100B and 102A, 102B dispense black (K) ink, print bars 100C and 102C dispense magenta (M) ink, print bars 100D and 102D dispense cyan (C) ink, and print bars 100E and 102E dispense yellow (Y) ink. Dryer 10 includes a first dryer 10A for drying one side of web 22 and a second dryer 10B for drying the other side of web 22. Dryers 10A and 10B may be housed together within a single dryer unit or separately.

FIG. 9 is a side view illustrating a counterflow dryer 10 such as the one shown in FIGS. 2-4 implemented in a two station inkjet web printer 88. Referring to FIG. 9, printer 88 includes a first printing station 98A with first print bars 100 for printing and drying the first side of web 22 and a second printing station 98B with second print bars 102 for printing and drying the second side of web 22. The web path extends from a web supply 104 to first printing station 98A, through a turn bar 106, to second printing station 98B, and then to web take-up 108. Each printing station 98A, 98B includes an arched printing unit 90A, 90B and a dryer 10A, 10B positioned under and contained within the footprint of the corresponding arched printing unit 90A, 90B.

As used in the Claims, "a" and "an" mean one or more.

As noted at the beginning of this Description, the examples shown in the figures and described above illustrate but do not limit the invention. Other examples may be made and implemented. Therefore, the foregoing description should not be construed to limit the scope of the invention, which is defined in the following claims.

What is claimed is:

1. A multi-stage hot air dryer:

a plurality of successive stages, in which each successive stage is configured to expose an article to higher humidity air first in the dryer and to lower humidity air last in the dryer as the article moves through the dryer from a last stage to a first stage;

wherein each stage of the plurality of successive stages includes:

a return chamber to direct the exposed air to a next successive stage; and a discharge chamber to expose the article to higher humidity air received from the return chamber of a previous stage.

2. The dryer of claim 1, wherein each successive stage includes a heater to heat the exposed air being pumped into the next successive stage, and a pump to pump the exposed air into the discharge chamber of the next successive stage.

3. The dryer of claim 2, wherein the dryer includes a drum configured to guide or carry a continuous web of material past each successive stage that is arranged next to one another around a circumference of the drum.

4. The dryer of claim 1, wherein the each successive stage is arranged next to one another linearly.

5. The dryer of claim 4, wherein:

a first set of successive stages are arranged next to one another along a line in a first direction to dry one side of a continuous web of material moving linearly past the first set of successive stages in a second direction; and a second set of successive stages are arranged next to one another along a line in the first direction to dry the other side of the continuous web of material moving linearly past the second set of successive stages in the second direction.

6. The dryer of claim 1, wherein the dryer further includes a drum, and wherein the discharge chamber is further configured as a group of discrete plenums arranged along a circumference of the drum.

7. The dryer of claim 1, wherein each return chamber is configured as a single chamber overlapping a discharge chamber.

8. A printer, comprising:

a printing unit to apply water based imaging material to a print substrate;

a dryer downstream from the printing unit to dry imaging material on the print substrate, the dryer including a plurality of successive stages and the dryer configured to blow higher humidity hot air on to the print substrate first in the dryer and then blow progressively lower humidity hot air on to the print substrate as the print substrate moves through the dryer from a last stage to a first stage;

wherein the dryer includes a plurality of successive stages and each stage of the plurality of successive stages includes:

a return chamber to direct the exposed air to a next successive stage; and a discharge chamber to expose the print substrate to higher humidity air received from the return chamber of a previous stage.

9. The printer of claim 8, wherein:

the printing unit comprises an arched printing unit including multiple inkjet print bars arranged along an arc for applying water based ink to a print substrate web; and the dryer includes a drum configured to guide or carry the print substrate web past the plurality of successive stages which are arranged next to one another around a circumference of the drum and the dryer is positioned within a footprint of the arched printing unit.

10. The printer of claim 9, wherein:

the multiple inkjet print bars comprise:

first print bars arranged along an arc on a first side of the printing unit for applying ink to one side of the web; and second print bars arranged along an arc on a second side of the printing unit for applying ink to the other side of the web; and the dryer comprises:

a first multi-stage dryer downstream from the first print bars to dry ink on one side of the web; and a second multi-stage dryer downstream from the second print bars to dry ink on the other side of the web, the first and second multi-stage dryers positioned within the footprint of the arched printing unit.

11. The printer of claim 9, wherein:

the arched printing unit comprises:

a first arched printing unit including first print bars arranged along an arc for applying ink to one side of the web; and a second arched printing unit including second print bars arranged along an arc for applying ink to the other side of the web; and the dryer comprises:

a first multi-stage dryer downstream from the first printing unit to dry ink on one side of the print substrate, the first dryer positioned within the footprint of the first arched printing unit; and a second multi-stage dryer downstream from the second arched printing unit to dry ink on the other side of the web, the second dryer positioned within the footprint of the first arched printing unit.

12. A process for drying an article moving through a dryer, comprising:

exposing, by a dryer comprising a plurality of successive locations, an article to air of decreasing humidity, as the article moves from a last location to a first location; and wherein each location of the plurality of successive locations includes:

a return chamber to direct the exposed air to a next successive location; and a discharge chamber to expose the article to higher humidity air received from the return chamber of a previous location.

13. The process of claim 12, wherein the exposing comprises:

blowing, from the discharge chamber of the first location, lower humidity air on to the article at the first location in the dryer; and collecting, by the return chamber of the first location, higher humidity air from the first location and blowing the higher humidity air on to the article at a second location in the dryer upstream from the first location in a direction the article is moving through the dryer.

14. The process of claim 13, further comprising:

heating the lower humidity air before blowing it on to the article at the first location; and heating the higher humidity air before blowing it on to the article at the second location.

15. The process of claim 14, further comprising:

repeating the steps of collecting, heating and blowing for at least a third location.

* * * * *